United States Patent [19]

Reil

[11] 4,101,051

[45] Jul. 18, 1978

[54] PACKAGING MEANS

[76] Inventor: Wilhelm Reil, Im Tiefen Weg 8, Bensheim-Auerbach, Hessen, Germany

[21] Appl. No.: 684,780

[22] Filed: May 10, 1976

[30] Foreign Application Priority Data

May 9, 1975 [DE] Fed. Rep. of Germany ..... 2520569
Jun. 11, 1975 [DE] Fed. Rep. of Germany ..... 2530945

[51] Int. Cl.[2] ..... B65D 5/70; B65D 5/54
[52] U.S. Cl. ..... 229/17 R; 229/7 R
[58] Field of Search ..... 229/17, 7, 51 ST, 51 D

[56] References Cited

U.S. PATENT DOCUMENTS

| | | | |
|---|---|---|---|
| 2,147,349 | 2/1939 | Piquerez | 229/17 R X |
| 2,819,831 | 1/1958 | Polarek et al. | 229/17 R |
| 2,979,249 | 4/1961 | Gill | 229/17 R |
| 3,127,082 | 3/1964 | Jagenberg | 229/7 R |
| 3,166,226 | 1/1965 | Mobly | 229/7 R |
| 3,301,458 | 1/1967 | Rausing et al. | 229/7 R |
| 3,367,551 | 2/1968 | Whebler | 229/17 R |
| 3,613,986 | 10/1971 | Christensson | 229/17 R |
| 3,650,458 | 3/1972 | Rausing | 229/17 R |
| 3,687,352 | 8/1972 | Kalajian | 229/7 R |
| 3,795,359 | 3/1974 | Rausing | 229/17 R X |

*Primary Examiner*—Davis T. Moorhead
*Attorney, Agent, or Firm*—Jacobi, Lilling & Siegel

[57] ABSTRACT

Packaging means for liquids of cardboard or the like, whose surfaces are liquid-impermeable, which has a tear-open spout, a perforation line in a wall of the packaging means forming a tear-off cardboard strip, and side and end walls separated by end edges, a covering strip of plastics material being sealed onto the inside of the packaging means in the region of the perforation line, wherein the perforation line is closed per se and a region without welding joints is formed between a covering strip and the tear-off cardboard strip at least on the inner end of the internally sealed-on covering strip remote from the front end of the spout.

13 Claims, 18 Drawing Figures

Figure 1:
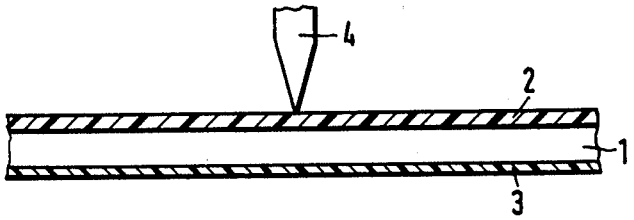

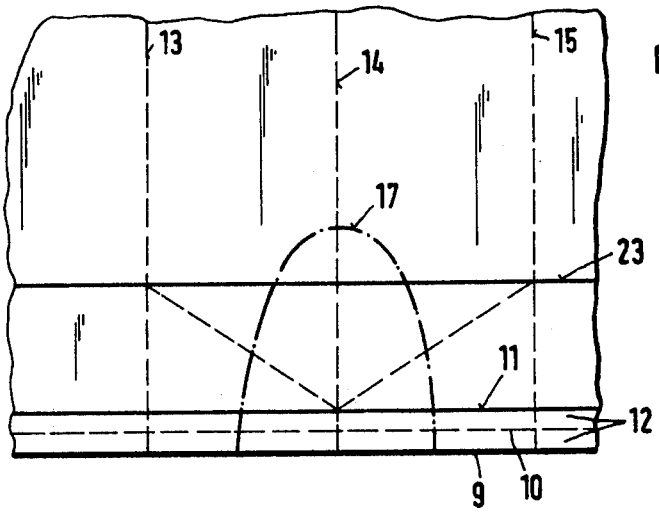
Fig.4
Fig.5
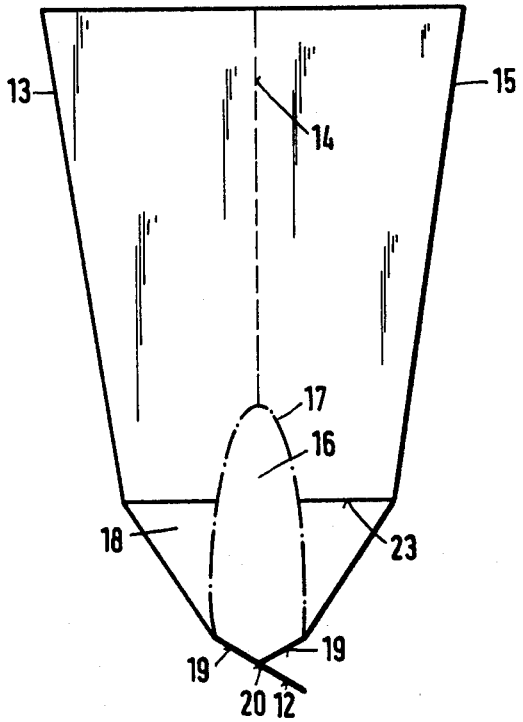

PACKAGING MEANS

The invention relates to a packaging means for liquids made of cardboard or the like whose surfaces are liquid-impermeable, which has a tear-open spout, a perforation line in a wall of the packaging means forming a tear-off cardboard strip, and side and end walls separated by end edges, a covering strip of plastic material being sealed on the inner side of the packaging means in the region of the perforation line.

Many examples of such packaging means are known in which cardboard, pasteboard or the like is used as carrier material, which is made liquid-impermeable at least on the inside by coating with a plastic material. They are suitable for pulverulent and granular material and also for liquids, for example milk.

Although the invention is not limited to packaging means formed from tubing by flattening and transverse sealing operations, this is nevertheless an illustrative embodiment by means of which the invention can easily be demonstrated. Such packaging means are often cuboid in shape and have sealing seams in the form of a circulating closure rib on two opposite side walls and an end wall. The main problem with such packaging means, especially as regards packaging liquids, is obviously impermeability. A further problem is the opening of the packaging means by the ultimate user, and providing as good a reclosure as possible. The invention is directed to providing a practical tear-open package means.

The invention is based on the principle of providing a packaging means for liquids with such a tear-open opening that a cardboard section formed by a loop-shaped perforation line is torn open on the upper end face without exerting the hitherto usual degree of force, the impermeability of the packaging being unimpaired. Also, this produces an improvement by facilitating handling of the packaging means and providing a more stable shape for handling.

The object is solved according to the invention if the perforation line is sealed per se and a weldless region is formed between the covering strip and the tear-off cardboard strip at least on the inside end of the internally sealed-on covering strip remote from the front end of the pourer or spout. For the first time this provides a satisfactory pouring spout which is simple to open and in which outstanding impermeability properties are nevertheless ensured despite the fact that the spout can be opened fully and easily. The cardboard strip can be grasped well and torn off via the weldless region. It is also advantageous according to the invention if the weldless region between the covering strip and the tear-off cardboard strip extends longitudinally at least on both sides of the perforation line. Surprisingly, sealing does not take place at the perforation line, so that permeable spots may occur which are not on the perforation cutting edges; this is a danger which has either not been recognised by all the packaging manufacturers, or up to now has been unavoidable, with the occurrence of faults and defects.

It is also advantageous according to the invention if the longitudinal edges of the approximately rectangular strips are arranged running towards one another in the tear-open direction. If a strip is torn upwardly in a cardboard ply without any particular guidance, the natural tractive forces cause the tear lines to run towards one another during the upward tearing movement. Benefit is obtained from this natural property by directing the lines of the longitudinal edges so as to run towards one another, whereupon not only is tearing open easier but the pourer itself can be made more pointed.

The invention can be especially advantageously employed in a packaging means with a doubled triangular flap having two inclined edges whose base is formed by the end edge and whose interior is joined to the interior of the packaging means along the base to form the pouring spout and is folded around adjacent side walls, and especially if the closed perforation line is provided in the upper end wall and extends beyond the flap, and if the perforation cuts penetrate the cardboard material including the coatings and the outer plastics is essentially impermeable.

It is in fact already known to make perforation lines — mainly in press machines or coating machines — and stick a covering strip from the inside onto the perforated place so as to make the packaging satisfactorily impermeable. The problem with this however is that such an opening can be opened only with difficulty, if at all, along the perforation line provided. The reason for this is that liquid packaging means of the type mentioned at the beginning are mass produced articles and the manufacture is only profitable if the paper machines and press and coating machines have high output rates and are thus adjusted to high turning speeds. Then however perforation can only be effected if the carrier material as such in the uncoated state is fully perforated, conveniently during the cutting out, folding and punching stages, and in some cases printing or coating stages, and is then coated with thin plastics layers, mostly of polyethylene. The coating on the inner side is somewhat thicker than on the outer side, and in each case the perforated places in the carrier material are of course coated, though these slight layer reinforcements are insufficient to ensure absolute impermeability and accordingly an additional covering strip is sealed, in a known manner, from the inside onto the damaged, perforated region. If this covering strip is sealed over the perforation line and/or slit seam onto the undamaged plastics film, a very firm and practically untearable perforation line is produced.

More easily tearable perforation lines are achieved by means of the features of the invention without the requirement of impermeability,. If the cutting knife, which on an enlarged scale is basically wedge-shaped penetrates the coated cardboard material on one side and runs against a roller, the operation of the knife can be controlled very exactly if it penetrates the side from below, i.e. penetrates from the 'later' inner side of the packaging to the coated cardboard carrier material and presses on the inner, somewhat thicker plastic film and to a certain extent the middle cardboard carrier layer, with the result that the sharp edge of the knife cuts the outer plastic film only in a straight line. In contrast to the known coated cardboard carrier materials in which the outer plastics sheets are undamaged and not perforated, in accordance with the invention a considerable weakening of both polyethylene sheets on the outside of the carrier material is produced, with the result that even after sticking on a covering strip the weakness remains because of the pressure on the specially weakened cutting place on the inside, and the tearing off operation along the perforation line is subsequently considerably facilitated.

A further advantage of the new cutting process is that the packaging means is practically undamaged on the outside and is thus protected against the external penetration of moisture. This exact cutting can also be carried out with machines having built-in perforating tools and set to run at high speed.

In a preferred embodiment of the invention the perforation loop is passed around the outer tip of the triangular flap to surround it completely. Seen from the side the perforation line forms a straight line extending from the tip of the pouring spout to the inside end of the opening in the upper end face. Sharp pouring contours are thereby ensured, and despite the easy tearing open operation and the extremely simple arrangement of the opening by means of perforation lines, all the known disadvantages are obviated and the packaging means is practical for the end user to manipulate.

It is particularly convenient according to the invention if the upper end face has a continuous smooth cardboard ply without any closure rib, if the perforation line, closed per se, on the side of the pouring tip in the same plane joins onto the closure rib, and if the packaging means is formed from tubing by flattening out and transverse sealing. The above-described perforation loop can also be provided in a conventional manner with closure ribs at upper end faces, though perforation lines have to be cut on opposite lateral regions which in each case represent half the total perforation loop. The last-mentioned embodiment avoids adjusting two separate tools arranged on the edges of the moving path of material and subsequent difficulties which may arise as regards the fact that the separately produced perforation line halves do not fit so as to 'cover' one another uniformly. As a rule these are in fact not very serious problems, but they may result in irregularities, which are avoided by the simple expedient of using, as the so-called "upper end wall", that end wall without a closure rib by rotating the cubiform packaging means. This rotation or turning of the packaging means is not obvious since manufacturers are basically very reluctant to lay impermeability-impaired ribs downwards on account of the fact that in the trade and the literature packaging means are almost always shown and described with the welding seam uppermost or on the side.

The smooth cardboard ply without closure ribs also has the advantage that the knives and counter rollers can be driven even more accurately in the formation of the perforation lines.

It is also advantageous according to the invention if the loop of the perforation line in the upper end face has, seen from above, the shape of an oblong circle or strip. In this connection a pear shape has proved very appropriate, the narrower end being arranged on the inside of the upper end face. At this point air has space through which to enter when the contents are being poured out, while at the opposite side, namely the tip of the pouring spout, a wider opening is desired for a fairly large pour-out jet.

However, it is also advantageous according to the invention if the loop of the perforation line in the upper end face has the shape of a rectangular strip, seen from above, with two longitudinal edges which are connected by a transverse line at the inside end of the strip and extend on the outside end on the tip of the flap through the closure rib as far as the free external edge in such a way that they are arranged running transversely on the assembled packaging means behind the outer fold-inclined edges and under the flap tip. The transverse lines impart a rectangular shape which may, if desired, be replaced by a circular crossing. A particular location is characteristic of the rectangular and also of the circular line arrangement of the perforation, namely, in accordance with the invention it is particularly advantageous if the rectangularly arranged lines at the inner end of the opening are cut lines and within the same a region is formed, without welding joints, between the covering strip and tear-off cardboard strip. If corners are provided on the said lines, then the small weldless region can be lifted up more easily from the plane of the upper end face and gripped so as to tear the cardboard strip upwardly.

Whereas in the case of the first mentioned embodiment with the perforation line in the form of an oblong circle or pear, the side faces have to be pressed together somewhat after tearing upwardly the stuck-on triangular flap in order to open a full packaging means, with the last-mentioned embodiment with the weldless region it is unnecessary to compress the full packaging means in order to grip the cardboard strip. This has the considerable advantage that any squeezing out of liquid immediately after the opening procedure is absolutely prevented and manipulation is considerably simpler for the consumer.

The invention is further characterised in an advantageous embodiment according to which embossed or stamped lines, which relative to the folding edge of the flap are symmetrical to its fold-inclined edges, are provided on the upper end face in such a way that the surface enclosed by the fold lines and embossed lines is rhombohedral or square in order to allow reclosure of the opening, and that in the case of the opened packaging means the distance between the end edge and the pouring spout is somewhat greater than the distance between the end edge and the weld seam. The weld seam lies on the edge of the small weldless region in the tear-open direction. Once a full packaging means has been opened the opening can in practice be completely reclosed by slight pressure on the tip of the pouring spout, which is a very practical feature for housewives. Reclosure is effected as with a push button since the spout tip can be pressed by simple finger pressure under the weld edge of the "smaller than a window" visible region, and engages there.

It is furthermore advantageous according to the invention if the line along the longitudinal edge of the opening is only on one side of a perforation line and the opposite cut line is formed by the free jointing edge of the cardboard sheet made into tubing, and the free jointing edge is sealed onto a unilaterally projecting plastic strip on the opposite sheet edge. The last-mentioned embodiment advantageously saves carrier material if, in the formation of the tubing, one free edge is laid joint by joint on the other free edge of the material sheet coated with polyethylene. The polyethylene strip projecting unilaterally over a free edge serves to connect the two. This new type of joining for the packaging tubing provides absolute liquid impermeability and a comparably strong packaging means without the above-described opening being rendered difficult; on the contrary, on account of the fact that a longitudinal edge of the opening is formed by a cut line the cardboard strip provided with the grip surface can be torn upwardly even more easily.

From this follows the further inventive advantage that the unilaterally projecting plastics strip is the covering strip sealed on over the perforation lines and cut lines. In this way three features are surprisingly combined, namely a connecting surface for the free jointing edge to form the tubing, the sealing of the opening made by the perforation line and cut line, and the preservation of all the advantages of the above-described tearing open procedure and saving in material.

It is also convenient according to the invention if the weld edge on the upper edge runs angularly in the form of a gable. With an exceptionally bad sealing of the covering strip from inside onto the lower film of the packaging means there could be a lesser adhesion than between the cardboard carrier material and the inner plastics film. In this case, the covering strip sealed on from the inside would, when upwardly tearing the cardboard strip, not tear from the weld edge in the tear-open direction but rather the inner plastics film would come away from the covering strip so that when the cardboard strip had been completely torn off the packaging means would nevertheless still be closed, namely by means of the plastic covering strip. If however the weld edge is arranged in such a way that the tip of the "gable" is the first to be subjecte to stress during the upward tearing motion, a tearing of the covering strip sealed on from below is guaranteed with a very high degree of probability even with bad adhesion of the afore-mentioned type, and accordingly the packaging means can be satisfactorily opened with certainty after the upward tearing motion of the cardboard strip.

By means of the invention an opening has been created for the first time in which the tear-open strip of cardboard is arranged directly in the flat upper end wall and even helps to form this end wall itself. This simple arrangement is very advantageous since the packaging means thus manufactured saves a great amount of material and does not produce environmental pollution problems, and can be mass produced without many labor problems and then marketed. An excellent price and cost benefit is achieved thereby. Another embodiment of the invention is preferably carried out in such a way that the covering strip is sealed externally at a distance around the perforation line on the inner side of the packaging means the perforation line extends outwardly somewhat from the central region of a packaging means wall and the covering strip is sealed in the region enclosed by the perforation line to form a pour opening on a surface which is smaller than the said region and is arranged near an end edge, as well as on at least one further face provided for the formation of air inlet openings. By means of the various adhesion zones, i.e. the different shapes of the surfaces on which the covering strip of plastics material is sealed onto the inner surface of the packaging means, widely varying types of opening and aeration can advantageously be achieved. Furthermore, the invention provides a perforation cover member which can easily be torn out, i.e. the cardboard strip can be torn off without having to pay attention to signs, descriptions, markings or other direction for use, and the desired pour opening is automatically produced. After the tearing off operation, a window with openings is visible in the region beneath the torn-off cardboard strip, the face of the "window" being formed by the plastic covering strip secured from the inside of the packaging means. This covering strip is thus torn off only at those places, in a definite manner to form holes or openings, at which it is still separately sealed on in addition to being sealed on externally around the perforation line. In other respects the pour jet is surprisingly narrow and well defined. This is partly explained by the fact that when tearing off the cardboard strip the plastic material of such covering strip adheres firmly to the pour side of the welded-on surface for the pouring opening and is somewhat stretched before the tearing off procedure, with the result that it has a spout shape after the tearing off.

If, according to a further advantageous feature according to the invention, the distance between the sealing edge of the covering strip and the perforation line is about 1 to 3 mm, a considerably improved impermeability is thereby produced in the manufacture of the packaging means. There are in fact relatively sharp edges and tips on the perforation line, and if the plastics covering strip is laid cold from the inside over the perforation line and is welded on externally only at a distance therefrom, the welding seam weakened by the sealing does not lie near the sharp edges and tips of the perforation line, which would otherwise possibly contribute to the formation of impermeability spots.

Yet again, the invention can be especially advantageously used for packaging means which in particular is provided with at least one of the afore-mentioned triangular flaps and is characterised in that the perforation line extends from the central region of the upper end wall up to the base of the triangular flap. Good pourability can be still further improved if, according to the invention, the perforation line closed per se runs in the end edge on the base of the triangular flap. The slightly extended face edge for the pouring opening through which the liquid is poured then projects at the end edge in the region of the base of the triangular flap so that the liquid stream which pours out is guided as if by guide surfaces in the form of a spout.

Furthermore, the pouring spout can be further improved if, in accordance with the invention, the perforation line at the ends of the part of the line running in the end edge on the triangular flap extends a short way further into the triangular flap. On tearing off the cardboard strip the effect of the extension of the covering strip on the pouring side of the face for the pouring opening is yet further substantially improved. Also, in the case of other embodiments where this extension of the covering strip on the torn out point or position is not ensured, this feature produces an additional guide or conducting surface for the jet of liquid pouring out, in fact by means of the small region between the parts of the line extending a short way into the triangular flap.

Another very advantageous further development of the invention for improving the extension effect of the covering strip on the tear-out side via which the jet of contents flows out consists of extending the perforation line into the triangular flap near its base. This is feasible in the case of the advantageous embodiment according to the invention in which the region enclosed by the perforation line is a rectangle: the narrow side of the rectangle, which lies at the spout "tip", is then next to the end edge at the base of the triangular flap in the latter, and if the pour-out edge of the torn-out pouring opening is arranged on the side over which the liquid jet flows and between the described perforation line part and the end edge on the flap base, the plastics material can extend particularly advantageously and to a great extent. The pour-our spout is then especially projecting, and tests clearly show that the packaging means material of the end edge in no way disturbs the effect of the projecting spout.

The invention is also advantageously developed if the perforation line in the development is in the form of a U and the non-perforated part is provided in the central region of the upper end wall. This feature is particularly suitable for the reclosure and/or recovering. The user will then tear the cardboard strip not from the central region of the upper end wall of the packaging means outwards, but in the opposite manner, namely from the outside towards the inside, with the result that after the tearing-off or tearing-upwardly procedures the cardboard strip remains adhering to the non-perforated position. It can then easily be moved back again so that no dust for example can get into the partly emptied packaging means. Grasping the cardboard strip in both directions is not at all difficult. In the first described embodiment in which the cardboard strip is torn away from the central region on the upper end wall forwardly to the narrow side wall of the packaging means, an additional cut can for example be provided so that one end of the tear-off strip projects slightly. On the opposite side according to the second embodiment, in which an upward tearing operation to the central region is carried out, the cardboard strip can be torn upwardly particularly well because the perforation line at the base of the triangular flap in the end edge stands up slightly by itself on account of the folding round of the triangular flap. This part of the perforation line is thus available for holding. Marking facilitates the use of this type of embodiment.

Advantageously, two sealing faces to form air inlet openings in the central region of the upper end wall and the face for the pouring opening are provided on the base of the triangular flap. In this connection the air inlet openings may be smaller than the pouring opening. The surface of a welding spot is suitable for the air inlet, while in a further advantageous embodiment of the invention a "house" shape has been found to be convenient for the surface of the pouring opening, whose gable tip is turned towards the air inlet openings and whose floor side forming the pouring edge is arranged at the base of the triangular flap.

The pouring opening first of all tears at the "gable tip", on further tearing it becomes wider, and before it is torn off the floor side on the base or end edge of the triangular flap, which is arranged transversely to the tear-off direction, ensures that before the plastic material is torn off it is first extended to a large degree on the pouring edge. If the position of the floor side of the pouring opening, i.e. the pouring edge, is described here, the expression "on the base" means that the said floor side may be in either the upper end wall or in the end edge or also in the triangular flap near the end edge.

In a further convenient embodiment of the invention the covering strip is sealed only along the edge of the face for the pouring opening, on the inner side of the packaging means. This provides better manufacturing possibilities. It is also advantageous according to the invention if the surface for the pouring opening is in the shape of a strip or rectangle running parallel to the end edge of the triangular flap. By means of this embodiment an improvement in the extension effect of the plastic part on the pouring edge can be achieved with the result that a whole plastics tongue or flap remains overhanging as a pouring guide.

A technical explanation for this follows from the fact that weak spots are always formed in the plastics material at the sealing on or sealing points. When the cardboard strip is torn upwardly the covering strip is first of all torn up at the frontmost welding spot lying transverse to the tear-open direction, with the formation of the pouring opening, it tears open further forming an extension of the pouring opening in the pouring direction until the end of the oblong region enclosed by the perforation line is reached at the spout "tip", where the resistance to tearing apart the plastic covering strip is now greater than the weakened welded spot, at which, as a result, the cardboard strip comes away from the flap-like, torn plastic strip. An overhanging plastic tongue thus remains standing, which advantageously assists in the pouring.

In the embodiment in which the perforation line in the development has a U shape, the open end of the U being situated in the central region of the upper end wall, it is particularly convenient if, in accordance with the invention, the surface for the pouring opening has an A shape whose free legs are arranged on or adjacent to the end edge of the triangular flap. If in this embodiment the cardboard strip is torn off from the region of the end edge to recover, the cardboard strip comes away from the plastic covering strip "above" the A in the direction of the central region of the upper end wall, and the surface below the two legs remains hanging on the packaging means as a pouring aid. In order to facilitate holding and upward tearing of the cardboard strip in the recoverable embodiment, in accordance with the invention the part of the perforation line connecting the legs of the U may be a cut line. The flap to be held then stands up slightly and can be grasped even better. As already mentioned, appropriate marking will show the tear-open direction with this embodiment.

Although the invention is not limited to packaging means formed from tubing by flattening out and transverse sealing operations, this is nevertheless an illustrative embodiment which represents a further advantageous form of the invention. A parallelepiped packaging container of the type in which the container is produced from a packaging material sheeting by bending the later into tubing, filling it with the relevant material, pressing it flat and sealing it in sealing zones at right angles to the tubing axis, and finally forming it into shape by folding the packaging material and separating it from the tubing (the packaging container having four double-walled regions lying at the corners of the packaging container), is characterised in that the part of the longitudinal seam of the tubing which lies between two successive transverse sealings of the tubing is on the floor of the packaging container and runs above this up to the tips of adjoining triangular flaps, the transverse sealing seams are located on two opposite, parallel side walls of the packaging container and run above this wall and up to the tips of the adjoining triangular flaps on the mentioned side walls, the upper side of the packaging means and the adjacent sides of adjacent, triangular flaps are flat and do not show any sealing seam, and the triangular flaps are bent to the adjoining side walls of the packaging means and sealed thereon, the upper triangular flaps being bent under the side walls of the packaging container and sealed thereon, which show the mentioned transverse sealing seams in order to form a flat, unbroken upper side of the packaging means. The production of parallelepiped packaging containers by flat pressing and sealing a tubing in sealing zones parallel to the tubing axis is known. If such a cushion-shaped tubing part is shaped into a parallelepiped packaging container, double-walled, triangular flaps are formed at the corners of the packaging container, of which one flap is normally used as a pouring spout for the packaging means if it is opened to give access to the contents. These known packaging containers have the disadvantage that the upper side of the packaging means has a sealing seam with two layers of material sealed to one another, the sealing seam being located centrally on the upper end surface of the packaging means. In the cases in which the triangular flaps are used as emptying openings, this sealing seam is not intrinsically disadvantageous; however, recently the wish has arisen to provide packaging containers of the afore-mentioned type with emptying openings which are easier to open and reclose, by for example providing a tear-off covering strip which is arranged over an existing hole in the packaging container. Since the upper side of the packaging means has a central, stiff sealing seam, it has hitherto been difficult or even technically impossible to provide a covering strip or a so-called "pulltab" opening on such packaging means.

In accordance with the invention some indication is given as to how the packaging container must be constructed in order to make such an emptying opening possible without the presence of sealing seams.

The invention is characterised in that the part of the longitudinal seam of the tubing which runs between two successive transverse sealings of the tubing is located on the floor or base of the packaging container and extends above this up to the tip of the adjoinin triangular flaps, the mentioned transverse sealing seams are located on two opposite, parallel side walls of the packaging container and run above this wall to the tips of the adjoining triangular flaps on the said side walls, the upper side and the adjacent sides of adjoining triangular flaps are flat and do not have any sealing seams and the triangular flaps are bent to the adjoining side walls of the packaging means and are sealed thereon, the upper flaps being bent under the side walls of the packaging container and sealed thereon, which have the transverse sealing seams to form a flat and unbroken upper side of the packaging means.

Figure 2:
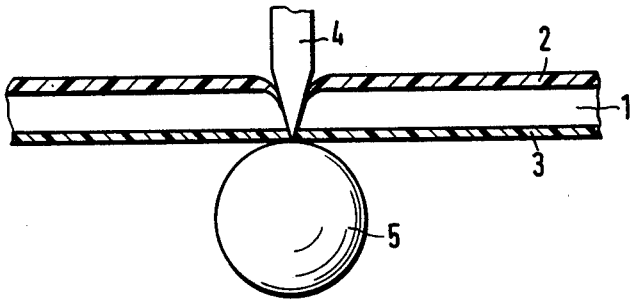
Figure 3:
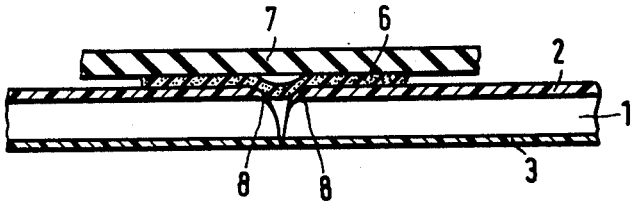
Figure 6:
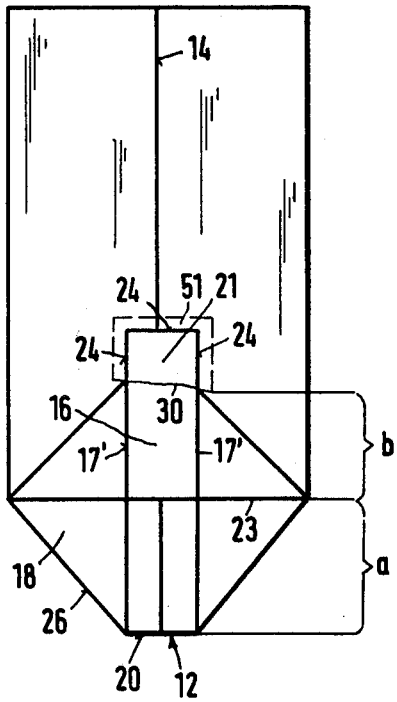
Figure 7:
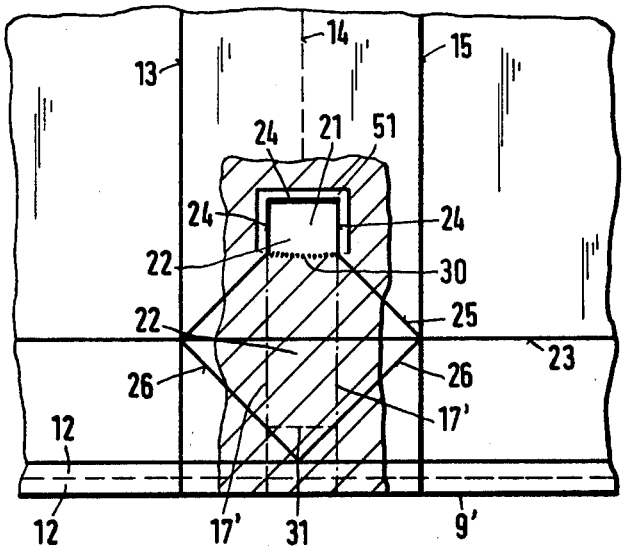
Figure 8:
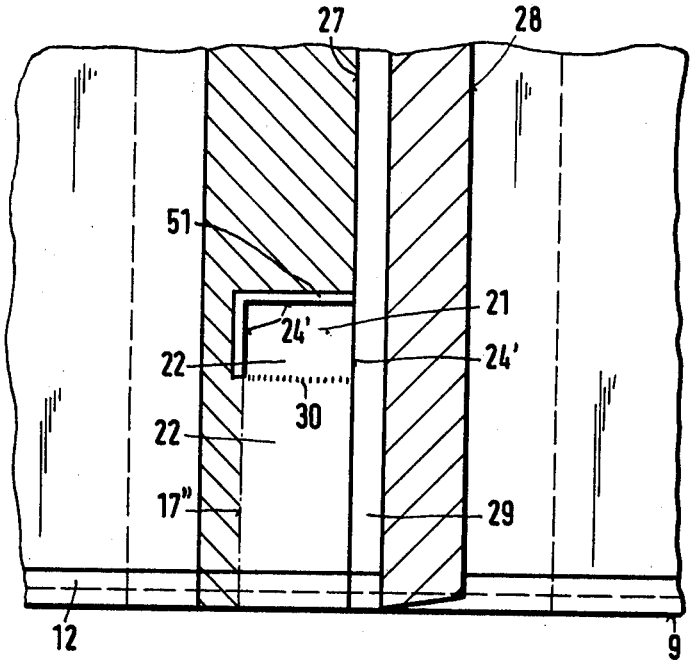
Figure 9:
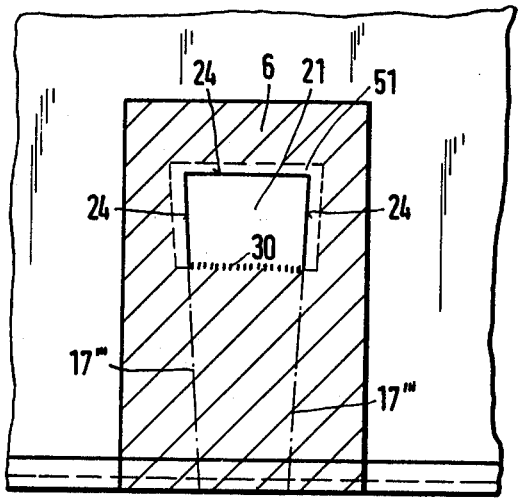
Figure 10:
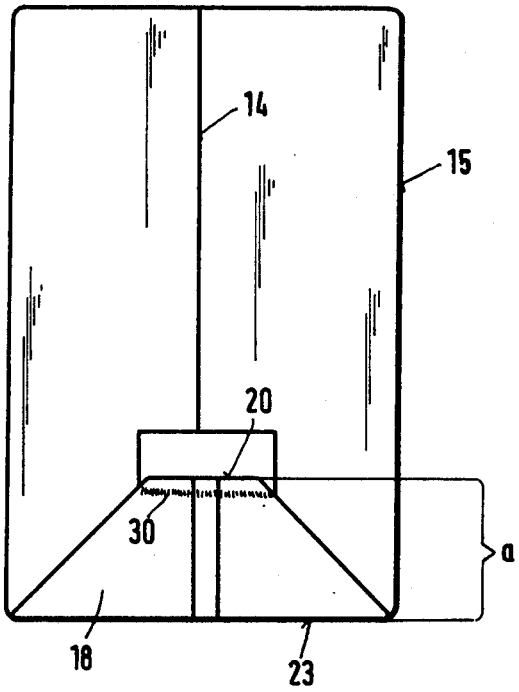
Figure 11:
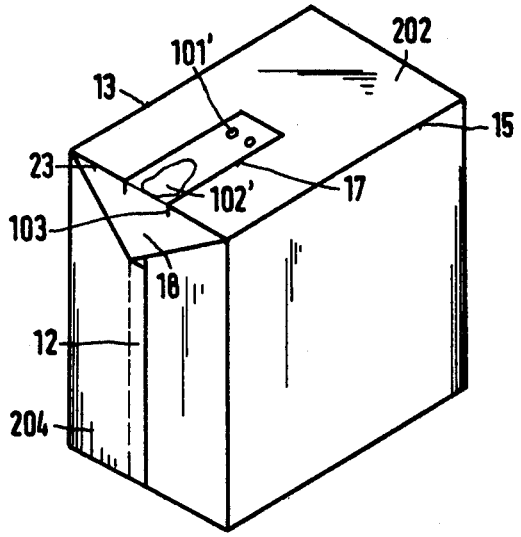
Figure 12:
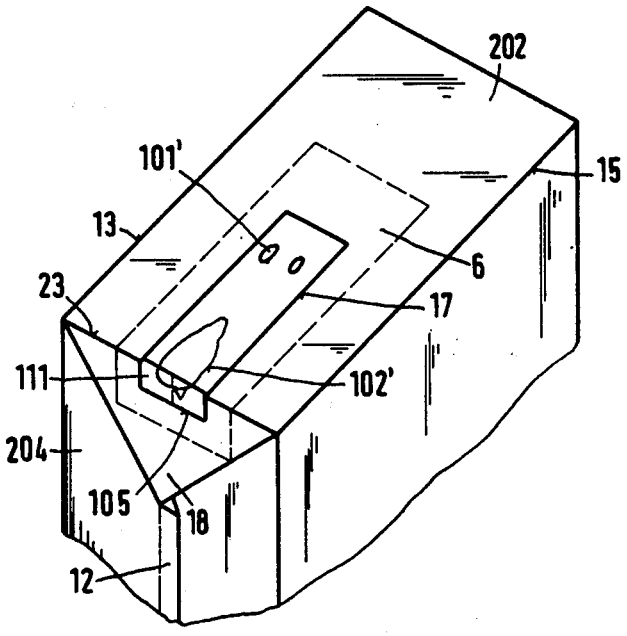
Figure 13:
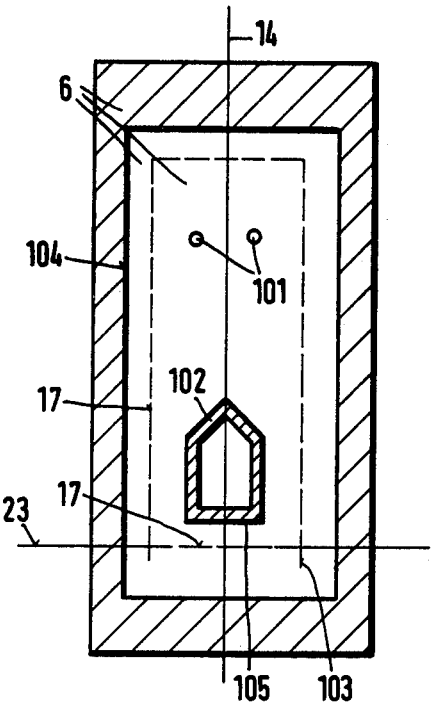
Figure 14:
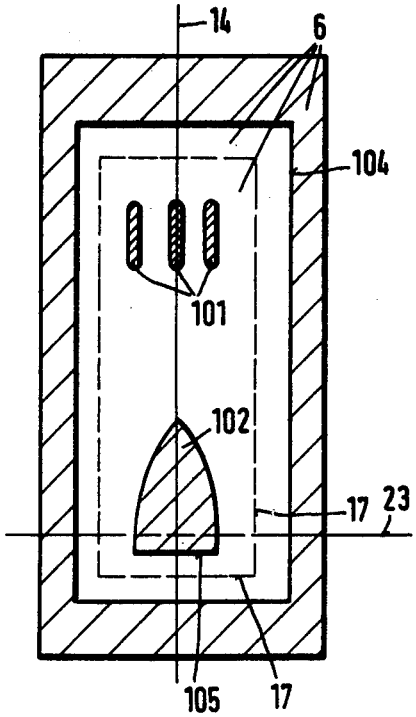
Figure 16:
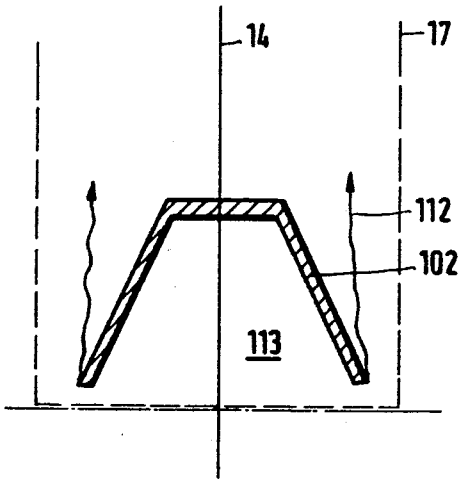
Figure 15:
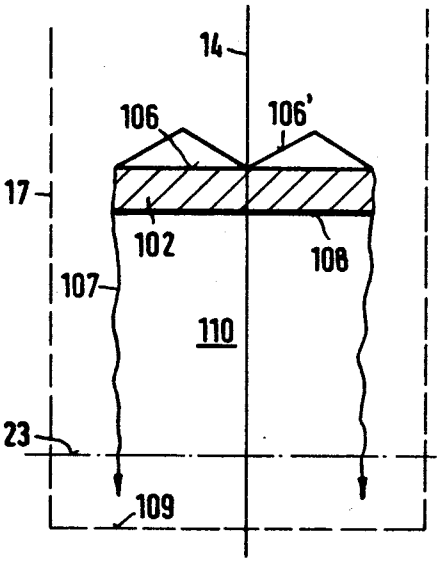
Figure 17:
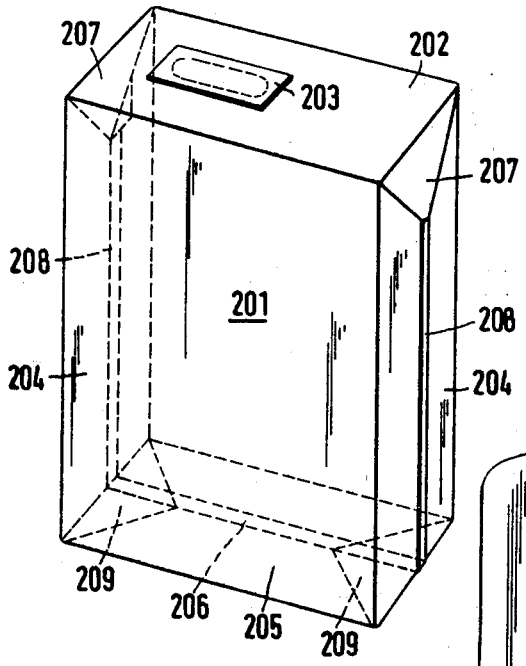
Figure 18:
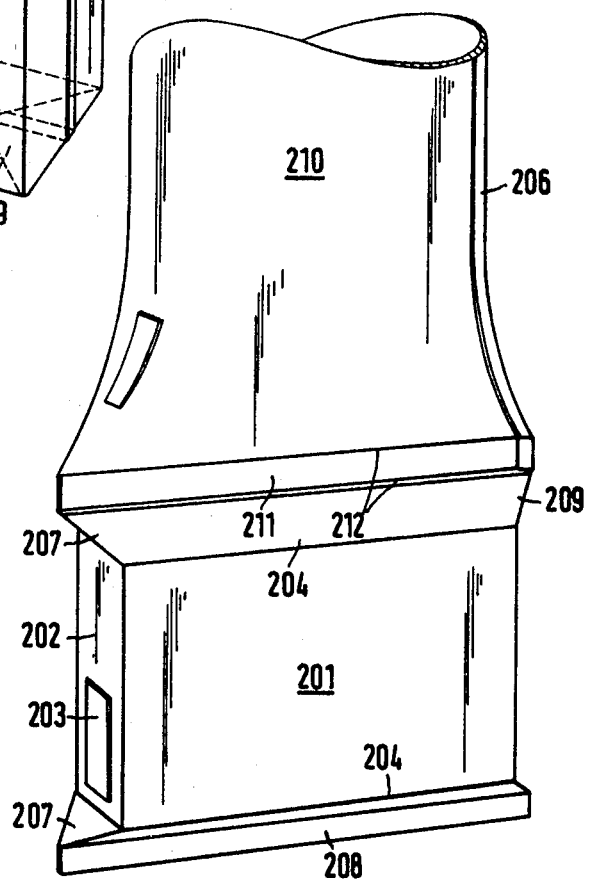

Further advantages, features and possibilities of application of the present invention will follow from the following description in conjunction with the drawings, in which:

FIG. 1 shows on an enlarged scale and in section a part of the two-sided, coated cardboard ply for the liquid packaging means, the diagrammatically shown knife being applied just before cutting, FIG. 2 is a similar view to that of FIG. 1, showing the knife having finished the cutting action, and its narrow edge in contact with the counter roller, FIG. 3 is a similar view to that of FIGS. 1 and 2 and shows the covering strip being sealed onto the inside of the packaging means material in the region of the cut, FIG. 4 shows the arrangement of a first embodiment of the packaging means with the tear-open opening formed by the closed perforation line loop, FIG. 5 shows the opened packaging means with a first embodiment of the perforation line in the form of an oblong circle, FIG. 6 is a similar view to that of FIG. 5, wherein a second embodiment of the tear-open opening after opening is shown, and the perforation line has the shape of a rectangle, FIG. 7 is a similar view to that of FIG. 4, and shows a part section with the tear-open opening of the second embodiment, FIG. 8 is a further embodiment with a tear-open opening for the packaging means, FIG. 9 is a view similar to that of FIG. 7 and shows another variant of the tear-off strip, FIG. 10 is a top view of a packaging means which has been opened by tearing open and has been reclosed, FIG. 11 is an isometric view of a packaging means with the opening device according to the invention in its upper end wall, FIG. 12 is a partial isometric view of a cuboid or parallelepiped packaging means with another embodiment of opening according to the invention in the upper end wall of the packaging means, FIG. 13 is a view of the inside of the upper end wall of the packaging means including a part of the triangular flap, FIG. 14 is a similar view to that of FIG. 13, in which another embodiment is shown, FIG. 15 is an enlarged view, similar to that of FIGS. 13 and 14, wherein only the opening shown in the vicinity of the narrow end edge of the packaging means on the base of the triangular flap is represented with a tear mechanism, FIG. 16 is a similar view to that shown in FIG. 15, in which anothe embodiment is shown for the surface of the pouring opening, FIG. 17 shows a finished packaging means with the flat and unbroken upper end wall according to the invention, and FIG. 18 is an illustration of the manufacture of the packaging means according to the invention.

The invention is not limited to a packaging means with triangular flaps or end regions; rather, the novel opening according to the invention can be provided at any arbitrary point on an otherwise formed packaging means if it has only one plane wall surface on which the necessary punching perforation can be carried out, and if the required plastic covering strip can be applied to the inside surface of the packaging means material. However, in order to understand the invention more readily a preferred embodiment of a parallelepiped packaging means with four triangular flaps or corner regions will be described purely for reasons of illustration, and the following description is not to be understood as being restricted to this preferred embodiment.

In order to form the perforation line for the tear-open opening provided in accordance with the invention, the packaging means material coated on both sides and ejected from the high speed rotary coating machine is subjected to a cutting operation. The packaging means material consists, according to FIGS. 1 to 3, of the middle layer carrier material 1, which is coated on both sides with a plastic film. A somewhat thicker polyethylene film 2, denoted by hatching, is situated on the inside of the packaging means, which in the representations of FIGS. 1 to 3 is arranged above the packaging means strip shown in cross-section. A thinner polyethylene film 3 is situated on the opposite side of the carrier material 1, which will later form the external 'skin' and is to protect the carrier material 1, consisting of cardboard, pasteboard or paper, from the external penetration of moisture. The knife 4 of the cutting device engages from the subsequent inner side of the packaging means, and is thus shown in FIG. 1 in the state shortly before the cutting process in which the knife 4 has reached the position in which its tip is against the inner plastic film 2.

After the cutting process has finished the state shown in FIG. 2 is reached. The sharp edge of the knife has cut through all three layers, firstly the somewhat thicker polyethylene film 2, then the carrier material 1, and finally, in the form of points or a line, the subsequent outer film, the knife 4 pressing against a roller 5 running over the outside of the packaging means material.

From the diagram of FIG. 2 it can be seen that the wedge of the knife 4, shown magnified, bends back the plastic layer 2 arranged on the inside of the packaging means with partial removal of the pasteboard material of the carrier layer 1 at the cutting location, forwardly in the direction of the knife edge, whereas there is, little distortion in the region of the thin plastic film 3. After the knife 4 has been withdrawn and removed from the station with the roller 5, the point- or line-shaped cut can hardly be detected on examining the packaging means material from the outer side, and also on examining the plastic film 3. In this way an optimum protection against liquid reaching the packaging means from outside is ensured, despite the cut through the coating 3. The disortion of the inner plastics layer 2 at the cutting point is important. According to FIG. 3 this is covered with a covering strip 6 of the same material, e.g. polyethylene, the covering strip 6 being welded to the plastic film 2. A counterpressure member 7 of rubber or the like provides the necessary contact pressure in the sealing process. It can be seen from the somewhat magnified diagram how the covering strip at the cutting point is squeezed into the forced-back regions, the elastic rubber member following it in the shaping. By means of this type of cutting of the already coated carrier material sheeting 1 and the positioning of the covering strip 6, absolute impermeability is achieved at the points indicated by 8 in FIG. 3 despite there being a weakness, with the result that the end user can finally tear through the perforation line without any special effort, i.e. separate the left half from the right half in the representation of FIG. 3.

FIG. 4 shows a part of the arrangement and layout for making cuboid packaging means formed from a tubing by flattening and transverse sealing operations. The cutting line 9 on which the moving material sheeting is cut and where the end of the packaging means will later be after it has been folded together, is shown at the bottom. The dotted line 10 which runs above and parallel theret denotes the sealing or welding seam, and from the whole arrangement the boundary between the closure rib, which in total is indicated by 12, and the remaining packaging means material is represented by the further magnified continuous line 11. Three dotted lines 13, 14 and 15 run perpendicularly to the lines 9 to 11, of which the middle line 14 forms the middle fold line and the outer lines 13 and 15 subsequently form the upper end edge between the corresponding side face and the upper end face. These edges may again be recognised in the opened packaging means seen from above in FIG. 5. The packaging means illustrated here always represent the embodiment in which that end surface of the cuboid packaging means in which there is no closure rib forms the "upper end wall" with the tear-open opening (FIGS. 5 and 6).

If a perforation line loop 17 is chosen as shown in FIG. 4 by the chain-dotted line, then on opening the packaging means an opening 16 is obtained in which the loop of the perforation line 17 has the shape of an oblong circle or of a pear. The tip of the triangular flap 18 can be recognised only from the arrangements according to FIGS. 4 and 7, and it does not coincide with the tip of the tear-open opening 16 in the embodiments shown here. Rather, the perforation line loop 17 in the finished packaging means is led around the outer tip of the flap 18, enclosing the latter, i.e. the edges 19 shown in FIG. 5 lie in the lower position of the double-walled triangular flap 18.

FIG. 6 shows another embodiment of the tear-open opening. The loop of the perforation line 17′ can be seen in the folded state of the flap 18 as well as in the state of the opened tear-open opening according to FIG. 6, as not being closed at the inner side opposite the tip 20 of the pouring spout. Because the perforation line 17′ formed as longitudinal edges is however in this embodiment also, led through the closure rib 12 to the free external edge 9′, the said line in the case of the opened packaging means shown here in FIG. 6 is arranged running transversely beneath the outer fold-inclined edges 26 and forms the pouring spout 20 shown here. To this extent this perforation line 17′ is also closed all around. As can also be seen in FIGS. 7 and 8 of the layouts for these other embodiments, the rectangular or square region 21, whose contours are not restricted by the invention, is without any sealing between the covering strip 6 from the inside and the packaging means material in the region of the opening 16. In this way a small corner is available as a tear-open aid for the tear-off cardboard strip 22. In addition, a narrow region 51 without welding — is arranged around the three edges 24 forming the region 21, so that the strip 22 which stands somewhat higher in the region 21 because of the paper stresses, can be held more easily. After the cardboard strip 22 has been torn off, according to the top view of the opened packaging means in FIG. 6, the covering strip sealed on from the inside, e.g. of transparent polyethylene, remains standing in the region 21. This does not disturb the pouring in any way, but instead serves for the reclosure.

In FIG. 7 the closure rib 12 is again shown at the bottom, parallel to which runs the fold line 23, which in the folded packaging means of FIGS. 5 and 6 forms one end edge of the packaging means on the base of the triangular flap 18. Perpendicularly to this fold line 23 in FIG. 7 are disposed the perforation lines 17′ on both sides of the central fold line 14, which lines 17′ transform into cut lines 24 in the region 21 so that in this case too the perforation line loop 17′, 24 can be regarded as closed per se in the representation of FIG. 6. The perforation lines 17′ may also be continued as perforation lines 24 in the region 21.

The embossed lines 13 and 15 intersect the fold line 23 at the corners of a square or rhombus whose other two corners end where the middle line 14 has reached on the one hand the middle of the region 21 and on the other hand the closure rib 12. The square or rhombus has the embossed lines 25, 26. The line 31 is simply imaginary and shows the point at which, the packaging means being opened, the pouring spout 20 according to FIG. 6 comes to rest. As already mentioned above, this line 20 is in fact actually formed by the two front ends of the perforation lines 17′.

In the embodiment according to FIG. 8 there is a new way of joining the free edges 27 and 28 of the packaging material sheeting in order to form the tubing for forming the packaging means. On one edge 27 a plastic strip 29 projects unilaterally, and the opposite sheeting edge 28 is sealed thereon after bridging the space shown by cross hatching in FIG. 8. If the outlines of the tear-off cardboard strip 22 are examined, it is found that above the perforation line 17″ shown by broken line, three cutting lines 24′ connect as in the embodiment of FIG. 7, which lines form the nonwelded region 21 between the covering strip 6 of plastic material and the tear-off cardboard strip 22. A cutting line is then joined on by virtue of the fact that the sheeting edges 27 and 28 have been arranged side by side and secured joint by joint in the formation of the tubing. The simple cross hatching in FIG. 8 shows the sealing region for the covering strip 6 applied from below. The rectangular region 21 with the two narrow edge or border regions, is left open, i.e. uncovered.

The embodiment according to FIGS. 6 to 10 is a practically air-free packaging means for liquids, and accordingly when the packaging means is placed with the opening arranged upwards, the liquid level lies directly at the under side of the upper end wall. By means of this fact on the one hand, and the middle fold line 15 in conjunction with the seal-less region 21 and the strip 22 separated by the perforation line 17,17' on the other hand, different paper stresses are produced in the closed state of the packaging means in the upper end wall on the one hand, and the region of the tear-off strip 22 on the other hand. Thus, on the transverse line 24 the strip in the region 21 stands higher or "arched", from which the user can see for himself without signs, arrows, descriptions, etc., that he must apply his fingers at this point. The gap between the plastic material in the region 21 and cardboard strip situated thereabove immediately suggests itself to the user that it should be grasped.

FIG. 9 shows, in a similar representation to that of FIG. 7, a part of the layout for the upper end wall with flaps 18, and the region of the covering strip 6 secured from below can be recognised by the hatching. The unhatched region is excluded from the sealing and forms the mentioned region 21, which is bounded from above by perforation or cutting lines 24, and from below by the welding border 30. This is angular in the form of a gable so that the tip of the gable at its widest portion is pushed forward to the middle of the region 21. In addition, the two longitudinal edges 17''' of the tear-off strip are arranged to run together to the closure rib 12 in order to facilitate further the tearing open procedure.

Finally, the packaging means after opening and reclosure is shown in FIG. 10, the distance *a* between the end edge 23 and the pouring spout 20 being less than the welding edge 30 of the window visible in the region 21. The condition for this has already been described above: the said distance *a* must namely be greater than the distance *b* between the end edge 23 and the welding edge 30. This can easily be achieved by appropriate shaping according to FIG. 6.

The packaging means according to the FIGS. 11 and 12 has cardboard, i.e. pasteboard, as the carrier material, which is made impermeable on both its surfaces by coating with polyethylene. The pouring spout which is to be opened by the tearing open procedure can be recognised in the upper end wall 202. At the side of the pour "tip", i.e. in FIGS. 11 and 12 in the front, left direction the upper end wall 202 is bounded by straight end edges 13, 15 and 23. In addition, the triangular flap 18 can be recognised in the front left, which is laid and sealed onto the adjoining side wall 204 in the middle of which approximately runs the closure rib 12.

The upper end wall 202 with the pouring spout provided therein, shown in the opened state in FIGS. 11 and 12, is essential to the following discussion.

In FIG. 12 the covering strip 6 on the inside of the packaging means is shown in its position on the upper end wall 202 or the triangular flap 18 by means of dotted lines. The perforation line 17, which in the embodiment of FIGS. 11–14 is closed per se, defines a rectangle whose narrow side located on the spout runs in the end edge 23 according to FIG. 11, and in the embodiment of FIG. 12 in the triangular flap 18 adjacent the end edge 23. The opposite narrow side of the rectangular perforation line 17 is situated in the central region of the upper end wall 202, where the cardboard strip is held and torn off in the embodiments of FIGS. 11–15.

As has been mentioned, FIGS. 11 and 12 show the upper end wall 202 of the packaging means after the cardboard strip has been torn off, whereupon the rectangular region of the covering strip 6 enclosed by the perforation line 17 is exposed. In other words, a transparent window can be seen in the rectangular region enclosed by the perforation line 17 since the covering strip 6 consists of transparent polyethylene. This rectangular window has three holes in the special embodiments of FIGS. 11 and 12, namely two air inlet holes or openings 101' in the middle region of the upper end wall 202, and one pouring opening 102' on the side at the end edge 23. The edges may be somewhat frayed after the tearing off operation, but this in no way impairs the functioning of the pouring spout. As previously mentioned many times, the covering strip 6 in an approximately 1–3 mm wide strip along the perforation line 17 as well as inside the region enclosed by this rectangular edge, is not welded to the upper side of the upper end wall 202. This is the reason why in FIGS. 11 and 12 the window is formed with holes by tearing off the cardboard strip.

Whereas in the known packaging means a closure rib has previously run in the middle of the upper end wall 202, this is omitted in accordance with the invention, as will be described below. In its place a folding line 14 can run along the middle of the upper end wall which in the FIGS. 13–16 as well as the bending-end edge 23 running transverse thereto, improves the clarity and comprehension of the arrangement. On examining FIGS. 13 and 14 the position of the two lines 14 and 23 are seen, from which point on the inside of the packaging means the upper end wall 202 is observed from below. The tear-open direction is assumed to be from top to bottom in the representation of FIGS. 13 and 14. The perforation line 17 is closed per se, and in both embodiments encloses a rectangular region. According to FIG. 13 the narrow end side of the rectangular perforation line 17 facing the pouring spout runs in the end edge 23, while according to FIG. 14 this narrow side of the perforation line 17 runs adjacent the end edge 23, i.e. adjacent the base of the flap 18. If tearing is carried out according to FIG. 13 beginning from above, and the region enclosed by the dotted line, the perforation line 17, namely the cardboard strip, is torn downwardly, then first of all only the coated carboard strip comes away from the adjacent material of the upper end wall 202; the height of the surfaces 101 for the air inlet opening 101' is then reached and at these points the covering strip 6 tears off as holes. The covering strip is sealed on along the hatched frame part on the inside of the packaging means, i.e. the lower surface of the upper end wall. If tearing is continued to the gable tip of the house-shaped or window-shaped surface 102 for the pouring opening 102', the tearing off of the covering strip 6 is repeated in the region of the surface 102. On reaching the floor of the "house" or window 102, the floor 105 forming the pouring edge, this is somewhat stretched by the increased resistance against the tearing of the covering strip 6. In this way the pouring edge 105 is formed, shown in FIG. 12 in the middle of the end edge 23.

In the embodiment of FIG. 11, whose pouring opening corresponds to the shape of FIG. 13, the perforation line 17 extends in the direction of the pouring spout along the end 103 a short way further beyond the bending-end edge 23, so that here too a pouring aid is produced if, on tearing the cardboard strip forwardly, the cardboard edge between the perforation line parts 103 and 117 are likewise bent slightly forward.

In the embodiment according to FIG. 13 two circular air inlet openings are provided, and in the embodiment according to FIG. 14 three oblong openings are provided, from which widely differing shapes and forms can be envisaged. Also, according to FIG. 13 the surface 102 for the pouring opening in the house shape with the gable tip pointed towards the air inlet openings, is only welded at the edge, while according to FIG. 14 the "church window" surface 102 is wholly welded onto the inside of the packaging means.

FIG. 15 is a further enlarged representation of the most important part of the pouring opening to be formed. As in FIG. 16, the lower part of the rectangularly orientated perforation line 17 can be recognised, somewhat symmetrically in the middle of the folding line 14, which in the lower region is intersected in a right angle by the end edge 23.

Instead of the surface 102 for the pouring opening provided in the house or window shape in FIGS. 13 and 14, according to FIG. 15 an approximately rectangular shape is provided which runs parallel to the end edge 23 of the triangular flap 18. In the representation of FIG. 16 the surface 102 is A-shaped, the free legs of the A being arranged immediately adjacent the end edge 23 of the triangular flap. The roof-shaped line 106' is preferably used to assist in tearing, and sealing is effected within the line according to the hatching. If in the embodiment according to FIG. 15 the cardboard strip (not shown) is torn from top to bottom in the direction of the arrow, then again first of all only the coated cardboard material comes away along the perforation line 17 from the surrounding upper end wall 202 until the upper line 106 or 106' of the strip-like surface 102 is reached. Since the welding between the covering strip 6 and the inside of the packaging means starts, there is a weakened edge here on which the covering strip tears, with the result that the side of the pouring opening away from the pour spout begins to form. Tearing is continued in the direction of the wavy line 107 indicated by the arrows, and the tear lines run approximately along the wavy line 107. Firstly, it should still be noted that the weakened transverse edge 108 exerts a greater resistance to the tearing off force than along the wavy tear line 107, with the result that the edge 108 first of all does not tear off but assists the adhesion between the covering strip 6 and the cardboard strip, which comes away in the direction of the arrow according to FIG. 15, along the perforation line 17 from the surrounding upper end wall 202. If the transverse side of the perforation line denoted by 109 in FIG. 15 is reached, the covering strip 6 tears off from the cardboard strip along the line of weakness 108 because below the perforation line 109 there is no weakness such as is produced by the sealing in 108. The result is that a tongue 110, enclosed within the wavy lines 107, remains hanging on the packaging means and assists in the pouring.

In the embodiment of FIGS. 12, 14 and 15, the liquid being poured out first of all flows over the material edge 23 and then over the pouring edge when the cardboard strip has been torn off. In FIG. 12 the material of the lower region of the flap 18 remaining upwards of the end edge 23 is denoted by 111. However, this does not impair the good pourability, which results from the stretched plastic part along the edge 105 or, in the other embodiment of FIG. 15, from the tongue 110.

In order to reclose the opened packaging means the user tears the cardboard strip from a point on the base, i.e., the end edge 23 of the triangular flap 18, upwardly. In the special embodiment shown in FIG. 16 the narrow rectangular side of the perforation line facing the pouring spout lies in the bending-end edge 23. As a result of the bending the perforation line opens easily and is available to be held by the user. On tearing upwards in the direction of the wavy arrow 112 the pouring opening begins to form on the free legs of the A of the surface 102, and becomes larger as upward tearing in the direction of the arrow is continued. In this embodiment it is noted that a tongue 113 remains enclosed under the outer contours of the A, because the covering strip with the torn off cardboard strip comes away only above the outer contours of the A and frees the pouring opening. It is thus possible, also when opening the pouring opening from the front, i.e. from the side of the pouring spout, to tear and yet at the same time provide a tongue 113, overhanging on the pouring edge, as a pouring aid.

The packaging container shown in FIG. 17 is rhombic or parallelepiped in shape and has two opposite side wall surfaces 201 as well as two other, smaller opposite side wall faces 204 and also an upper end wall 202 and a lower floor face 205. In the embodiment shown the packaging means has an opening device 203 which consists of a hole in the upper end wall 202 of the packaging means as well as a tear-off covering strip applied over the said hole. The packaging means has upper triangular double-walled flaps 207 which have part of the sealing seams 208 on their under side, which are formed by flat pressing and transverse sealing in a manner still to be described. The mentioned sealing seams 208 run along the whole central parts of the side walls 204 as well as along the upper sides of the double-walled triangular flap 209 bent in to the floor part 205, the flap also having parts of a sealing seam 206 on its under side, and the said seams 208 also run on the under sides of the flaps 207. The seam 206 extends in the middle over the whole floor area 205 and over the triangular flaps 209 up to the tips thereof.

The upper triangular flaps 207 are bent under to the side wall surfaces 204 and sealed thereon, while the lower triangular flaps 209 are bent to the floor 205 of the packaging container and sealed thereon. As follows from the above description and FIG. 17, the upper flaps 207 have a sealing seam 208 only on the sides of the areas which are sealed on the packaging container, while on the other hand the triangular flaps 209 have sealing seams both on the upper side and also on the lower side, which run from the base of the flaps 209 up to their tips. There the sealing seams 208 and 206 meet and close to form a long, interconnected sealing seam 208-206-208, the end points of the said long interconnected sealing seam lying on the tips of the upper flap 207. As can be seen from FIG. 17, the upper end wall 202 of the packaging means is quite flat and does not have any sealing seam. This means that the upper end wall 202 can be used for example for an opening indication of the type shown in FIG. 7, which however cannot be applied in the manner indicated if the upper end wall 202 has a sealing seam or some other irregularity or discontinuity.

FIG. 18 illustrates the principles involved in the production of the packaging means according to FIG. 17. Since however the shaping principle for parallelepiped packaging means and also the arrangements for sealing a tubing are well known, these details have been omitted for the sake of clarity. Instead, in FIG. 18 only the tubing of packaging means material and a shaped and formed packaging container are shown.

The tubing 210 shown in FIG. 18 is formed by doubling or folding together a flat sheeting of packaging means material so that the longitudinally running end edges of the sheeting are joined to one another, inside to inside in a seam, to form a sealing seam 206. The packaging material sheeting has previously received an opening arrangement 203 which consists of a hole in the packaging material sheeting as well as a covering strip covering the mentioned hole. The tubing 210 is pressed flat in the region 211 and sealed along the narrow sealing zones 212. These zones run transverse to the tubing and perpendicularly to the axis of the tubing. The tubing has previously been filled with suitable material, and in the flat pressing and scaling of the tubing a certain amount of the material is enclosed between two successive flat pressing zones 211 of the tubing.

The shaping of the sealed tubing part is performed using known arrangements, not shown here, which conveniently consist of cooperating shaping surfaces which can move towards one another and can close to form a hollow shaping space whose inner contours correspond to the desired packaging means appearance. When shaping material which is not very flexible, such as for example laminated material, in which paper or pasteboard is a basic constituent, the shaping must be carried out without plastic deformation of the packaging means material, i.e. there must not be any extension of the material, otherwise the paper material would break. Instead, the shaping operation is effected by folding the material and in order to facilitate this folding it is advantageous to imprint a bending line pattern in the packaging material sheeting, which facilitates the fold shaping. In the fold shaping triangular, double-walled flaps 207, 209 are formed at the corners of the packaging means container in the boundary line between the side wall surfaces 204 as well floor part 205 and upper end wall 202. One of the flaps can be utilised to form a pouring spout of the packaging means to empty it. In this case the tip of the flap which is to serve as emptying opening is cut off. In the present case no flap is provided for this purpose, but as already mentioned a covering strip is provided for the emptying device, which is arranged over an emptying hole previously made in the packaging means material sheeting. The triangular flaps have a certain stiffening effect on the packaging container however, and with this embodiment the upper flaps 207 are bent over to the side walls and secured thereon to form an unbroken upper end wall 202, while the lower flaps are bent over to the floor of the packaging means container and secured thereto, which considerably mechanically strengthens the floor surface. As can be seen from FIG. 18, the finished packaging means containers are separated from one another by a cut through the flat-pressed zone 211. In this connection socalled transverse sealing seams 208 are formed, which, starting from the tip of one of the triangular flaps 207, run over the whole side wall region 204 up to the tip of the opposite flap 209.

The sealing seam 206, or more correctly the part thereof, will with each packaging means lie between the transverse sealing seams 208 and extends from the tip of a flap 209, over the floor area 205 and up to the tip of the opposite flap 209. The sealing seam 206, which is a part of the longitudinal seam of the tubing, joins with the transversely running sealing seams 208 at the tips of the triangular flaps 209 to form an unbroken and continuous U-shaped seal.

According to FIG. 18 the packaging means is furthermore made so that in the shaping it is rotated by 90° in relation to the orientation which the packaging means has if it is to be used, and this orientation of the packaging means makes it possible to provide the packaging means with a plane upper side 202, which is a prerequisite for an opening arrangement 203 of the type illustrated and described to be used.

What we claim is:

1. Packaging means for liquids or the like, comprising a spout portion and a wall extending into said spout portion, a perforation line in said wall defining a tear-off strip, and a covering strip of liquid-impervious material being secured to the inner surface of said wall and positioned over said perforation line to close and seal it, a portion of said tear-off strip remote from said spout portion being unattached to said covering strip to facilitate gripping and removal of said tear-off strip and opening of said spout portion.

2. Packaging means according to claim 1, wherein the unsecured region between the covering strip and the tear-off strip extends longitudinally at least on both sides of the perforation line.

3. Packaging means according to claim 1, wherein the tear-off strip is approximately rectangular and the sides thereof defined by the perforation line are arranged to run towards one another in the tear-open direction.

4. Packaging means according to claim 1, having a triangular flap with two inclined edges, the base of said flap being formed by one edge, the interior of said flap being connected along the base with the interior of the packaging means to form said spout portion, said flap being folded around adjacent walls of the packaging means, the perforation line extending over the flap.

5. Packaging means according to claim 4 wherein the perforation line is passed around the outer tip of the flap and encompasses it.

6. Packaging means according to claim 5, wherein the perforation line has roughly the shape of a rectangle with the formation of the tear-off strip, with two longitudinal edges which are connected at the inside end of the tear-off strip by a transverse line and extend at the outer end on the tip of the flap up to the free external edge thereof in such a way that they are arranged running transversely on the packaging means behind the outer folded edges under the flap tip.

7. Packaging means according to claim 1, wherein the covering strip is secured to the inner wall surface around and at a distance external to the perforation line, the perforation line extends outwardly approximately from the mid region of the wall, and the covering strip in the region enclosed by the perforation line is secured to a

8. Packaging means according to claim 7, wherein the region enclosed by the perforation line is a rectangle.

9. Packaging means according to claim 7, wherein the distance between the edge of the covering strip and the perforation line is approximately 1–3 mm.

10. Packaging means according to claim 1, further comprising a triangular flap, the perforation line extending from the central region of the upper end wall of the packaging means to the base of the triangular flap.

11. Packaging means according to claim 10, wherein the perforation line runs to the base of the triangular flap.

12. Packaging means according to claim 11, wherein the performation line extends into the triangular flap in addition to the base thereof.

13. Parallelepiped packaging means according to claim 1, of the type in which the container is produced from a packaging means material sheeting which is bent into a tubing, filled with the relevant material, pressed flat and sealed in sealing zones at right angles to the tubing axis, as well as being finally shaped by folding the packaging material and then separated from the tubing, wherein the packaging means container has four double-walled triangular flaps which lie on the ends of the packaging means container, that part of the longitudinal seam of the tubing lying between two successive transverse sealings of the tubing being located on the floor or the packaging means container and extending above the floor up to the tips of adjacent triangular flaps, the transverse sealing seams being situated on two opposite, parallel side walls of the packaging means container and running above this wall and up to the tips of the adjacent triangular flaps on said side walls, the upper end wall of packaging means and the neighboring sides of adjoining, triangular flaps being flat and not having any sealing seams and the triangular flaps being bent to the adjoining side walls of the packaging means and sealed thereto, wherein the upper triangular flaps are bent under the side walls of the packaging means container and sealed thereto to form a flat and unbroken upper side of the packaging means.

* * * * *